US005122035A

United States Patent [19]

Juhola

[11] Patent Number: 5,122,035

[45] Date of Patent: Jun. 16, 1992

[54] LIQUID RING COMPRESSOR

[75] Inventor: Pentti Juhola, Espoo, Finland

[73] Assignee: Pentamo Oy, Espoo, Finland

[21] Appl. No.: 613,897

[22] PCT Filed: Jun. 7, 1989

[86] PCT No.: PCT/FI89/00100

§ 371 Date: Dec. 13, 1990

§ 102(e) Date: Dec. 13, 1990

[87] PCT Pub. No.: WO89/12168

PCT Pub. Date: Dec. 14, 1989

[30] Foreign Application Priority Data

Jun. 8, 1988 [FI] Finland ..... 882712

[51] Int. Cl.[5] ..... F04C 19/00

[52] U.S. Cl. ..... 417/68; 418/100

[58] Field of Search ..... 417/68, 69; 418/100

[56] References Cited

U.S. PATENT DOCUMENTS

| | | | |
|---|---|---|---|
| 953,222 | 3/1910 | Nash | 417/68 |
| 1,668,532 | 5/1928 | Stewart | 417/68 |
| 2,937,499 | 5/1960 | Klemt | 417/68 |
| 3,154,240 | 10/1964 | Jennings . | |
| 3,366,314 | 10/1965 | Schroder | 417/68 |
| 3,395,854 | 8/1968 | Martin et al. | 417/68 |
| 3,721,508 | 3/1973 | Mugele . | |
| 4,172,694 | 10/1979 | Haavik . | |
| 4,422,832 | 12/1983 | Haavik | 417/68 |
| 4,498,844 | 2/1982 | Bissell et al. | 417/68 |
| 4,565,498 | 1/1986 | Schmid et al. | 417/68 |
| 4,747,752 | 5/1988 | Somarakis | 417/68 |
| 4,861,246 | 8/1989 | Zimmern | 418/100 |

FOREIGN PATENT DOCUMENTS

| | | | |
|---|---|---|---|
| 0138310 | 4/1985 | European Pat. Off. . | |
| 0274272 | 7/1988 | European Pat. Off. | 417/68 |
| 451681 | 10/1927 | Fed. Rep. of Germany . | |
| 876286 | 7/1949 | Fed. Rep. of Germany . | |
| 553332 | 8/1974 | Fed. Rep. of Germany . | |
| 2704863 | 8/1978 | Fed. Rep. of Germany . | |
| 3210161 | 10/1983 | Fed. Rep. of Germany . | |
| 3337837 | 4/1985 | Fed. Rep. of Germany . | |
| 3446583 | 7/1985 | Fed. Rep. of Germany . | |
| 2264201 | 10/1975 | France . | |
| 26049 | 7/1915 | Norway . | |
| 426069 | 10/1974 | U.S.S.R. . | |
| 1038583 | 8/1983 | U.S.S.R. . | |
| 1498952 | 8/1989 | U.S.S.R. . | |
| 1011451 | 12/1965 | United Kingdom | 417/68 |
| 2064002 | 6/1981 | United Kingdom . | |

*Primary Examiner*—Richard A. Bertsch
*Assistant Examiner*—Michael I. Kocharov
*Attorney, Agent, or Firm*—Oliff & Berridge

[57] ABSTRACT

A liquid ring compressor has an annular space between the rotor and the rotor axle, the annular space being connected with the rotor compression zone through two or more discharge openings. The liquid ring compressor is operated with improved efficiency.

12 Claims, 8 Drawing Sheets 25
24
10·3
23
20'
10·2

8
9
19
18

LIQUID RING COMPRESSOR

The object of the invention is a liquid ring compressor and vacuum pump.

The known liquid ring compressor has a casing with a rotor inside, mounted off-centre. The casing contains liquid which is caused by the centrifugal force of the rotor to rotate along the periphery of the casing. Since the rotor is mounted off-centre, the inner surface of the liquid ring moves up and down in the rotor vane slots as the rotor turns. The slots are connected to the gas inlet when the liquid ring moves outwards, away from the bottom of slot. The slots are connected to the outlet when the distance between the liquid ring and the bottom of the slot is at a minimum. During the compression phase the opening at the bottom of the slot is closed whereupon the liquid penetrating the slot compresses the gas. Since small amounts of liquid leave the compressor along with the gas, a corresponding amount has to be continuously replaced.

Liquid ring compressors are used in the processing industry, in particular for transferring large amounts of gas. These pumps are particularly useful when the gas contains solid impurities.

One liquid ring compressor is presented in the publication U.S. Pat. No. 3,154,240.

The known liquid ring compressors have an in-built, essentially constant pressure ratio. This implies a need for extra power when the compressor is operated at a pressure ratio deviating from the design value. Furthermore, a constant pressure ratio causes problems when starting the pump, if there is no pressure difference between the inlet and the outlet.

Now the liquid ring compressors will be defined more closely.

The rotor of the now-invented liquid ring compressor is equipped with a flange to which the vanes are attached. At the opposite end, the vanes are connected to each other with a ring flange. The gas to be compressed is led from the compression zone of the rotor to a walled-off annular space, between the axle and rotor and from there to the outlet.

One of the characteristics of the invention is that, preceding the actual discharge, there are in the walls of the annular space a number of intermediate outlets equipped with a valve.

One of the characteristics of the invention is that the compressor casing is a drum rotating in the same direction as the rotor.

One of the characteristics of the invention is that vanes become separated from the liquid ring at the induction zone.

One of the characteristics of the invention is that the compressor is equipped with a cooling system with which liquid coolant can be injected into the vane slots.

One of the characteristics of the invention is that there is an interconnection equipped with a valve from the outlet side of the compressor to the inlet side.

One of the characteristics of the invention is that there are guide plates in the casing outside the rotor.

One of the characteristics of the invention is that the slots in the induction phase are connected via grooves to the induction chamber.

Some of the advantageous characteristics of the invention are described in detail below. The schematic figures are side projections in which FIG. 1 displays a liquid ring compressor as per the invention, as seen parallel to the axle, i.e. from the front.

FIG. 2 is an alternative detail of the compressor in FIG. 1 as seen from the front.

FIG. 3*a* displays another compressor as per the invention, as seen from the side.

FIG. 3*b* shows the compressor in FIG. 3*a* as seen from the front,

Figure 1:
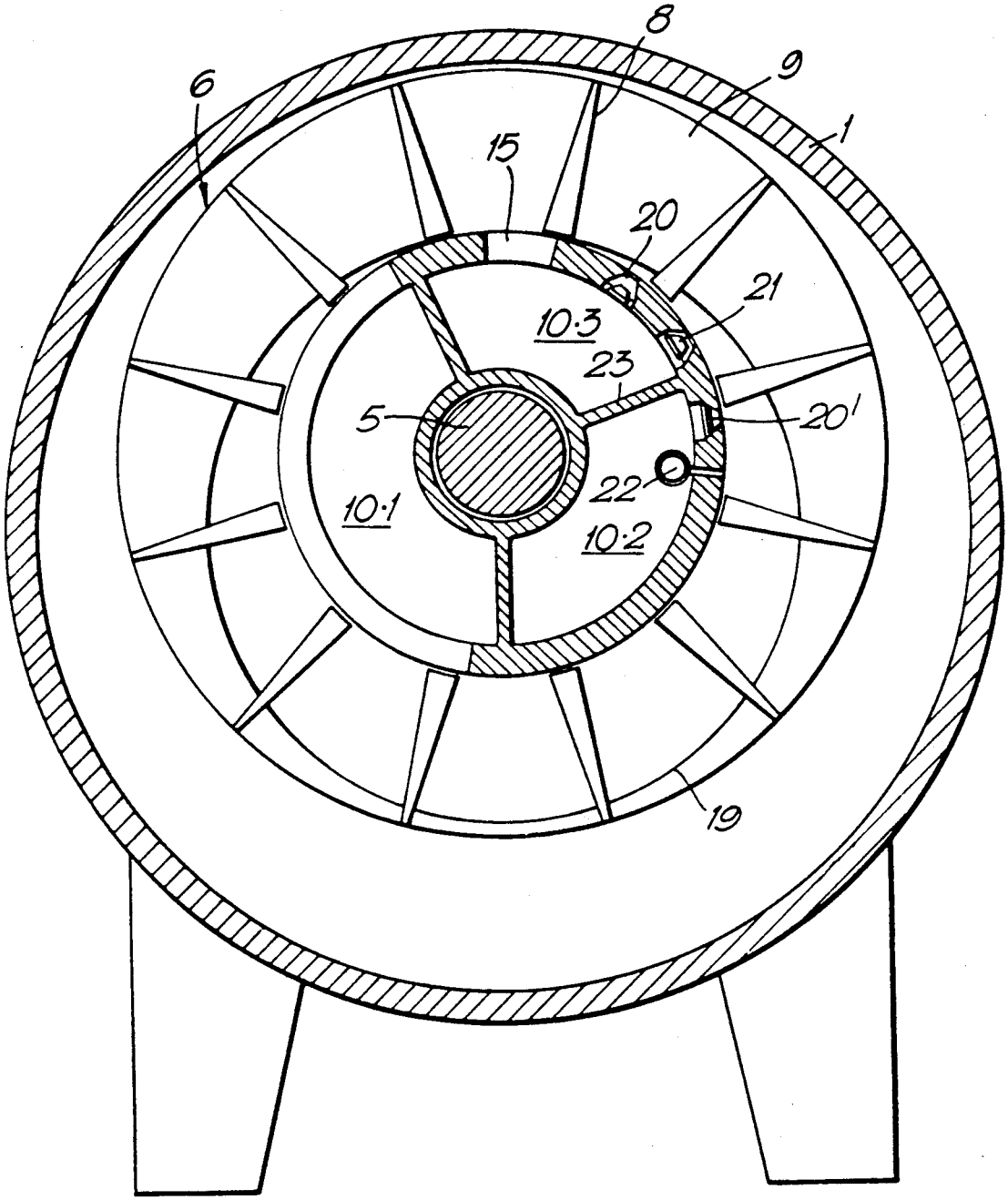

The liquid ring compressor shown in FIG. 1 has a fixed cylindrical casing 1, and the casing a rotor 6 placed on an eccentrically moving axle 5. The rotor has an end flange to which the vanes 8, which are parallel to the axle, are attached. The other ends of the vanes 8 are connected with a ring flange 9. Between the vanes 8 and the axle 5 there is an annular space, which is separated with a wall from the axle 5 and from the slots between the vanes.

The annular space is divided with the walls 23 into three sector-like spaces. Section 10.1 is connected to the inlet channel, section 10.3 to the outlet channel and section 10.2 to a separate outlet channel in which the pressure can be lower than in the outlet channel 10.3.

There is liquid in the casing 1. As the rotor 6 revolves, the centrifugal force causes the liquid to form a ring on the periphery of the casing 1. The volume of the liquid is such that when the rotor 6 revolves, the tips of the vanes 8, when in the lowest position, barely penetrate the liquid. In the upper position the liquid touches the bottom of the vane slot. The inner surface of the liquid ring is represented by the line 19.

The gas to be compressed is led along the induction channel to the section 10.1 of the annular space, which in turn is connected with the vane slots in the induction phase. As the vane slots turn from the induction phase to the compression phase, the liquid moving into the slot starts compressing the gas.

When in the highest position, the slot passes the discharge opening 15 leading to the annular space 10.3.

Ahead of the actual discharge opening are a number of intermediate outlets 20 equipped with valve 21, some of them issuing to the annular space 10.3 and others to the annular space 10.2. The valves can be non-return valves or positively controlled valves. The valves prevent the gas from being compressed to a pressure essentially higher than the pressure in the outlet channel. This makes the starting easier, particularly when the compressor is used as a vacuum pump.

From a compressor as shown in FIG. 1 some of the gas to be compressed can be discharged at a pressure lower than the final pressure.

Figure 2:
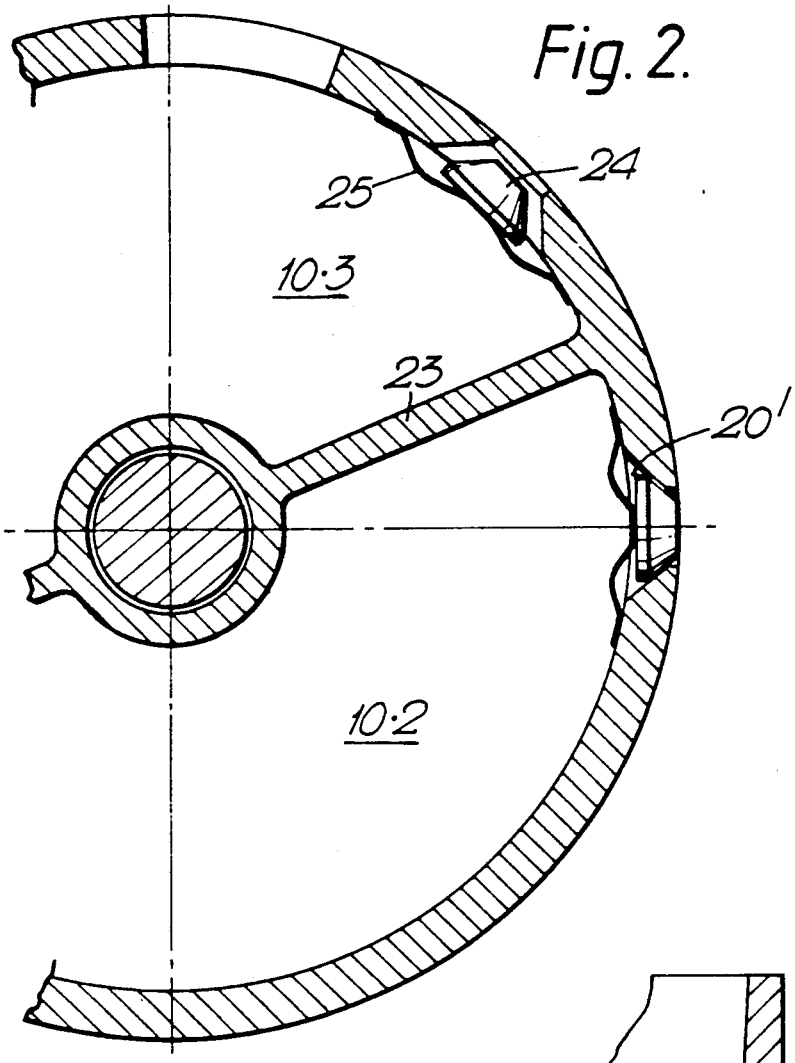

FIG. 2 shows an alternative annular space which is divided with the discharge wall 23 into two sections. The first section 10.2 is connected with the compression zone via the intermediate discharge opening 20'. Some of the gas to be compressed can be discharged via the first section at a pressure lower than the final pressure. This is an essential benefit in many circulating processes. Using this arrangement, it is, for example, possible to improve the efficiency of a heat pump.

FIG. 2 shows an example of the non-return valve 21. It has a conical opening tapering towards the outer surface of the wall and the corresponding breech 24. The breech 24 is controlled by the spring 25. When the pressure in the annular space 10.2 is higher, the breech is pressed against the edges of the opening.

The compressor is also provided with the cooling system 22 with which cold liquid, preferably the same liquid that the liquid ring consists of, can be injected in a vane slot during the compression phase.

The cooling system 22 includes a tube passing through the annular space 10.2, with a mouth and nozzle which are attached to the wall of the annular space.

Figure 3A:
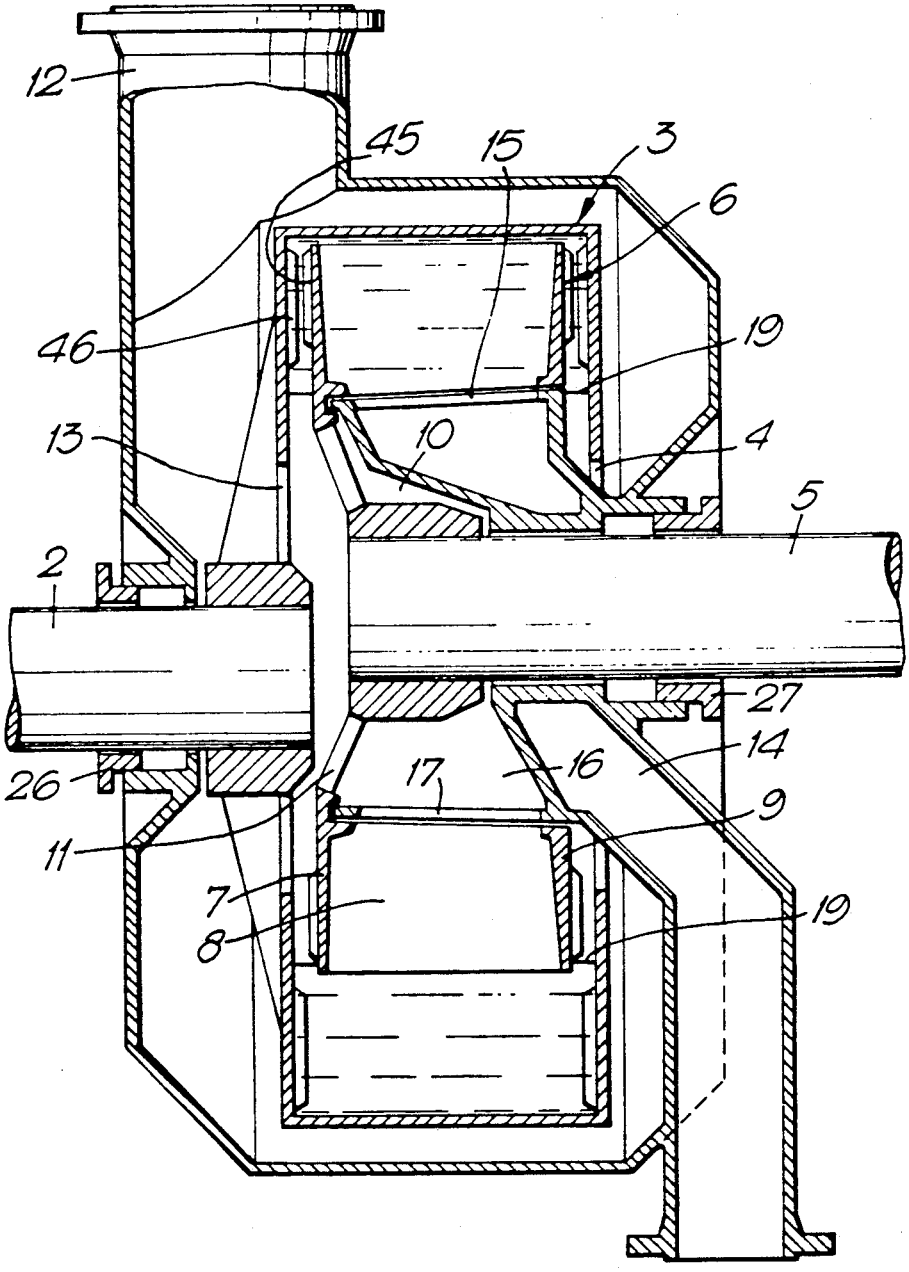
Figure 3B:
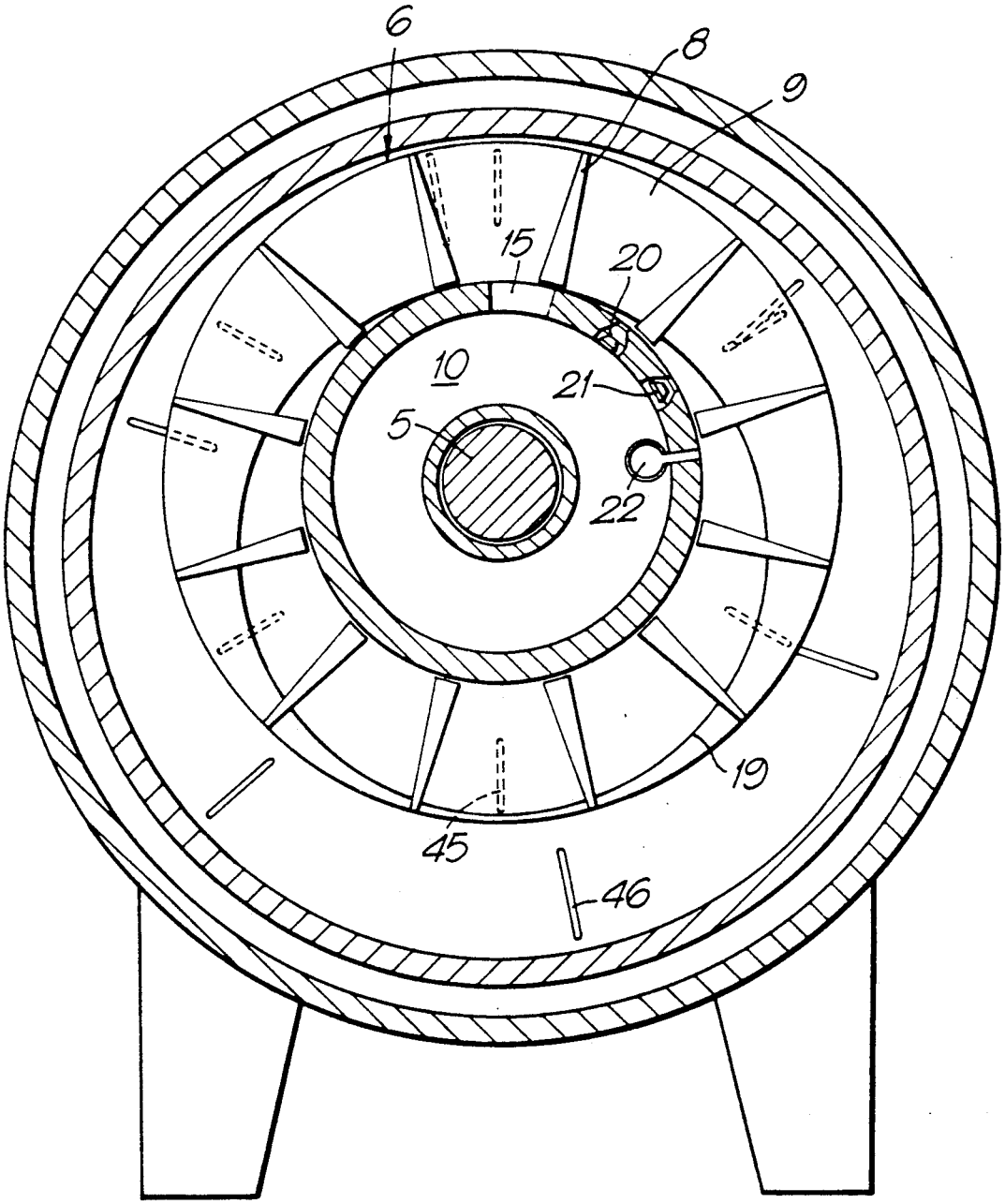

The efficiency of the compressor can be essentially improved by fitting, as shown in FIGS. 3*a* and 3*b*, a drum 3 on the axle 2 rotating between the casing 1 and the rotor. This way the friction of the liquid ring periphery is essentially diminished, since the speed of the liquid ring relative to the casing can be reduced. When the drum 3 and rotor 6 are rotating at the same circumferential velocity, the only difference in speed is the slip caused by the eccentricity.

When the friction is decreased, the rotational speed can be correspondingly increased. Thus it is possible to use higher pressure ratios and higher back pressure. Furthermore, higher centrifugal force makes it possible to regulate the speed over a higher capacity range, but the pressure difference causes no essential variations in the thickness of the liquid ring between the outlet and the inlet.

The compressor shown in FIGS. 3*a* and 3*b* has a fixed cylindrical casing 1, a drum axle 2 attached to the casing with a bearing, and a cylindrical drum 3 rotating in the casing fixed at the end of the axle. In the centre of the end furthest away from the drum axle there is an opening 4. On the opposite side is a rotor axle 5, which is placed above drum axle 2. Rotating on this axle is a rotor 6 which is placed inside the drum. The rotor 6 is equipped with end flange 7 attached to the end of the axle 5. The vanes 8 pointing towards the opening 4 are fixed to the flange 7. The opposite ends of the vanes 8 are connected to each other with the ring flange 9. Between the vanes 8 and the axle 5 there is an annular space 10 connected to the drum through the openings 11 in the end flange 7. The inlet socket 12 of the gas to be compressed is attached to the casing 1. The gas enters the drum 3 through the openings 13 in the drum end close to the axle.

Placed in the annular space 10 is the discharge channel 14 which is connected via 15 with the uppermost slot of the rotor 6. Separated from the discharge channel with a wall, the lower part of annular space 10 forms inlet channel 16 which is connected via 17 to the slots of the rotor in the induction phase.

Figure 4:
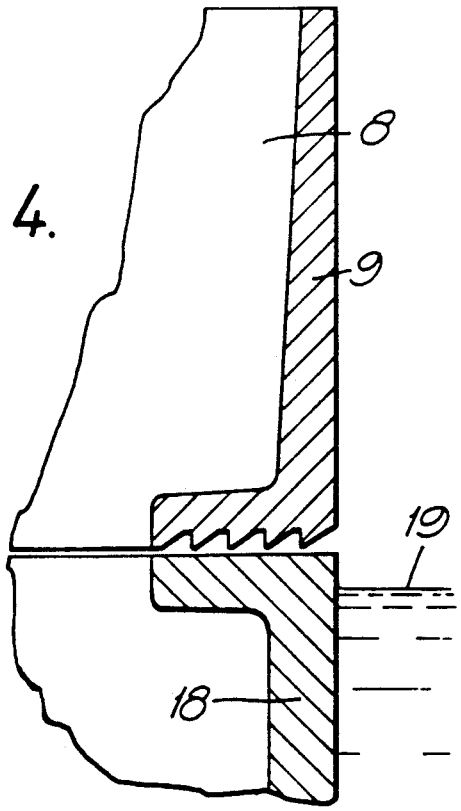
FIG. 4 is a magnification of a detail from FIG. 3*a*.

The height of the vanes 8 is higher at the bearing end of the axle 5 of the rotor 6 than at the other end, whereby the annular space is conical. This means that the inner surface 19 of the liquid ring at the topmost part of the casing 3 at the opposite end of the axle is below the bottom edge of the flange 9 and the vanes 8 (FIG. 4). This feature is used for sealing the space between the flange 9 and the wall 18 of the discharge 14 by making threads on the lower edge of the flange. These threads tend to force water from the drum into the compression space.

The seals 25 and 27 of the axles 2 and 5 are placed so that they can be serviced from outside the casing.

The gas entering the drum 3 flows through the openings 11 to the annular space 10 and from there via the inlet opening 17 to the slots of vanes 8 in the induction phase.

As the slots turn away from the opening 17, the liquid penetrating the slots starts compressing the gas until the slot reaches the topmost position at the discharge opening 15 through which the gas flows into the discharge channel 14.

The applications shown in the FIGS. 3*a* and 3*b* can also have intermediate outlets (FIG. 3*b*) closed with a valve in the compression zone of the rotor 6. The last discharge opening can also be closed with a valve. The intermediate openings can be used for bleeding gas at different pressures into separate discharge channels.

In order to reduce the slip, the rotor and the drum are provided with ribs 45 and 46. Alternatively, the drum and the rotor may be rotated as positively guided in relation to each other.

Figure 5:
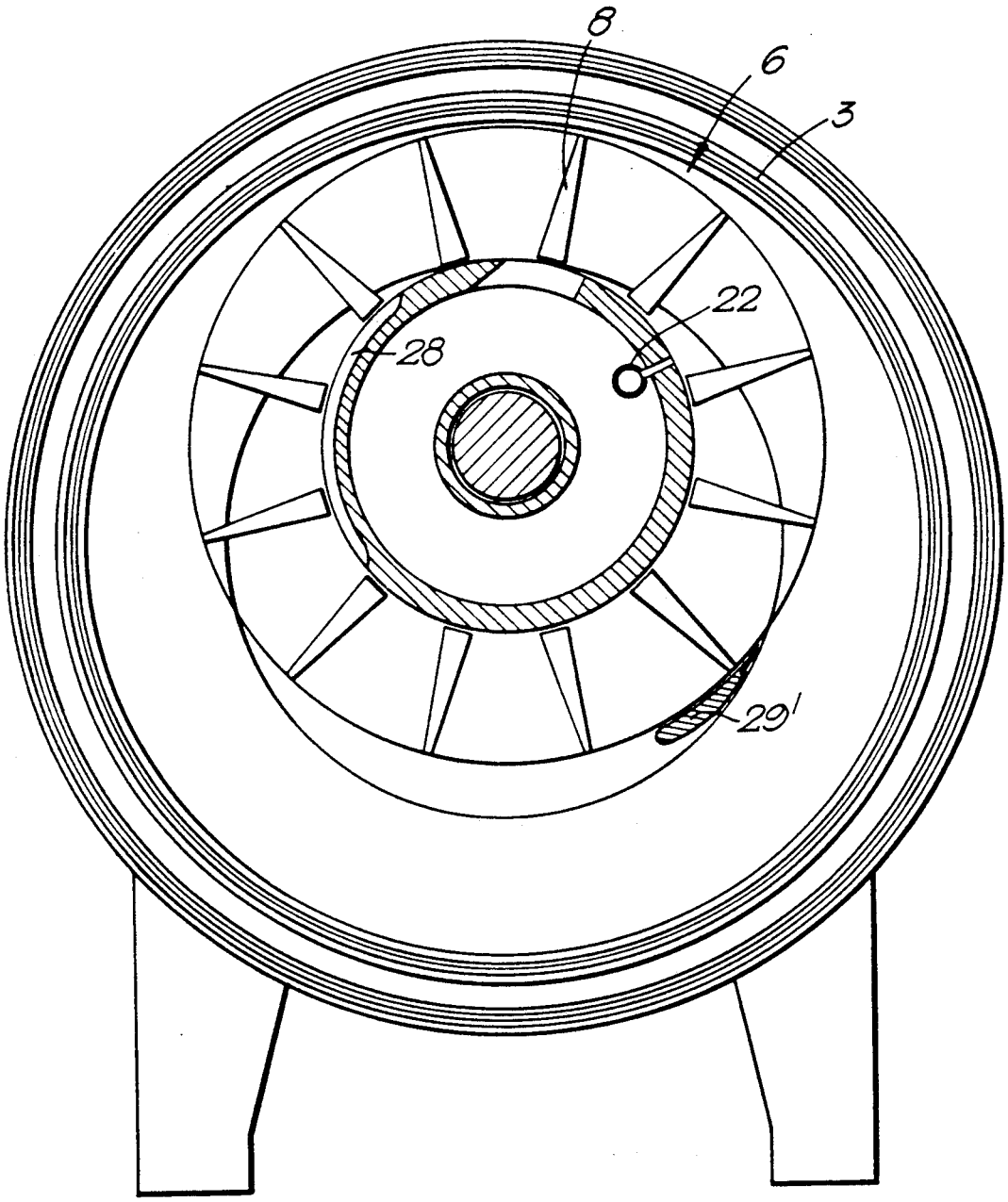
FIG. 5 shows a third compressor as per the invention as seen from the front.

In the application as shown in the FIG. 5, the off-set between the rotor 6 and the drum 3 has been increased and the rotor diameter has been correspondingly decreased whereby the tips of the vanes 8 lose contact with the liquid ring in the induction zone. In this case, the gas can be supplied over the periphery of the rotor. Even with this arrangement it is of course possible to use intermediate outlets, cooling 22 and rotary drum 3.

In the application as shown in the FIG. 5, there are groove-like vacuum relief channels 28 on the outer surface of the annular space 10 in the vacuum building area after the discharge. Those channels 28 connect the induction zone with the slots that have just passed the outlet. This way the evaporation of the sealing liquid is prevented and the running is more even.

Figure 6:
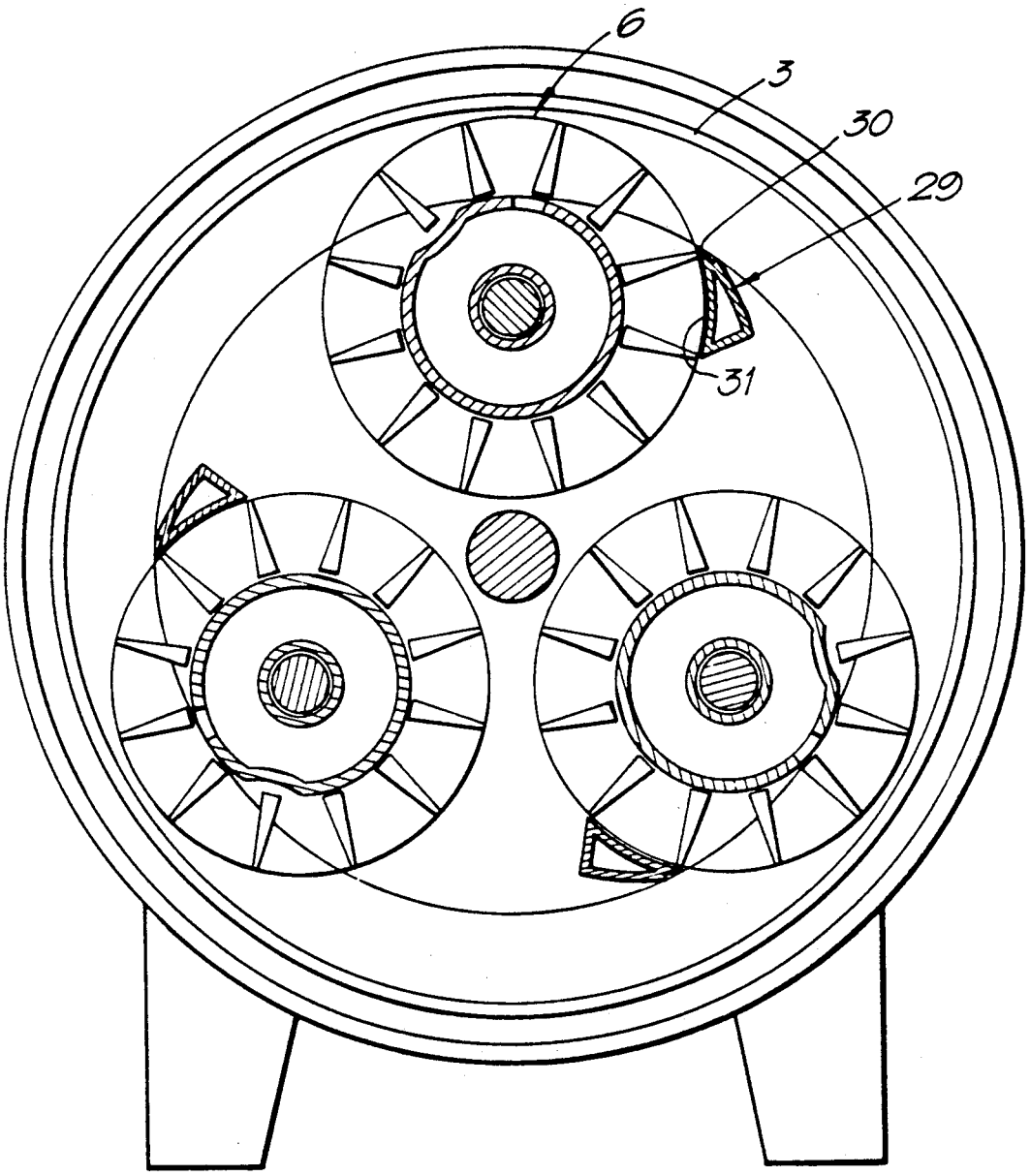
FIG. 6 shows a fourth compressor as per the invention as seen from the side.

In the arrangement where the liquid ring is disconnected from the rotor 6 in the induction zone and the gas is led to the periphery of the rotor, several rotors 6 can be placed in the same drum 3. Such application is shown in FIG. 6. In it there are three rotors 6 in the drum 3.

In the application as shown in the FIG. 6, guide plates 29 attached to the casing 1 are used for improving the volumetric efficiency. These guide plates are placed immediately ahead of the rotor 6 compression zone so that the rear edge of the plate is in contact with the liquid ring. The inner edge 31 of the guide plate 29 is curved and it rests against the outer periphery of the rotor 6. The purpose of the guide plate 29 is to prevent the gas being compressed from discharging from the slot that is not yet sealed by the liquid ring, sealed by the liquid ring.

Figure 7:
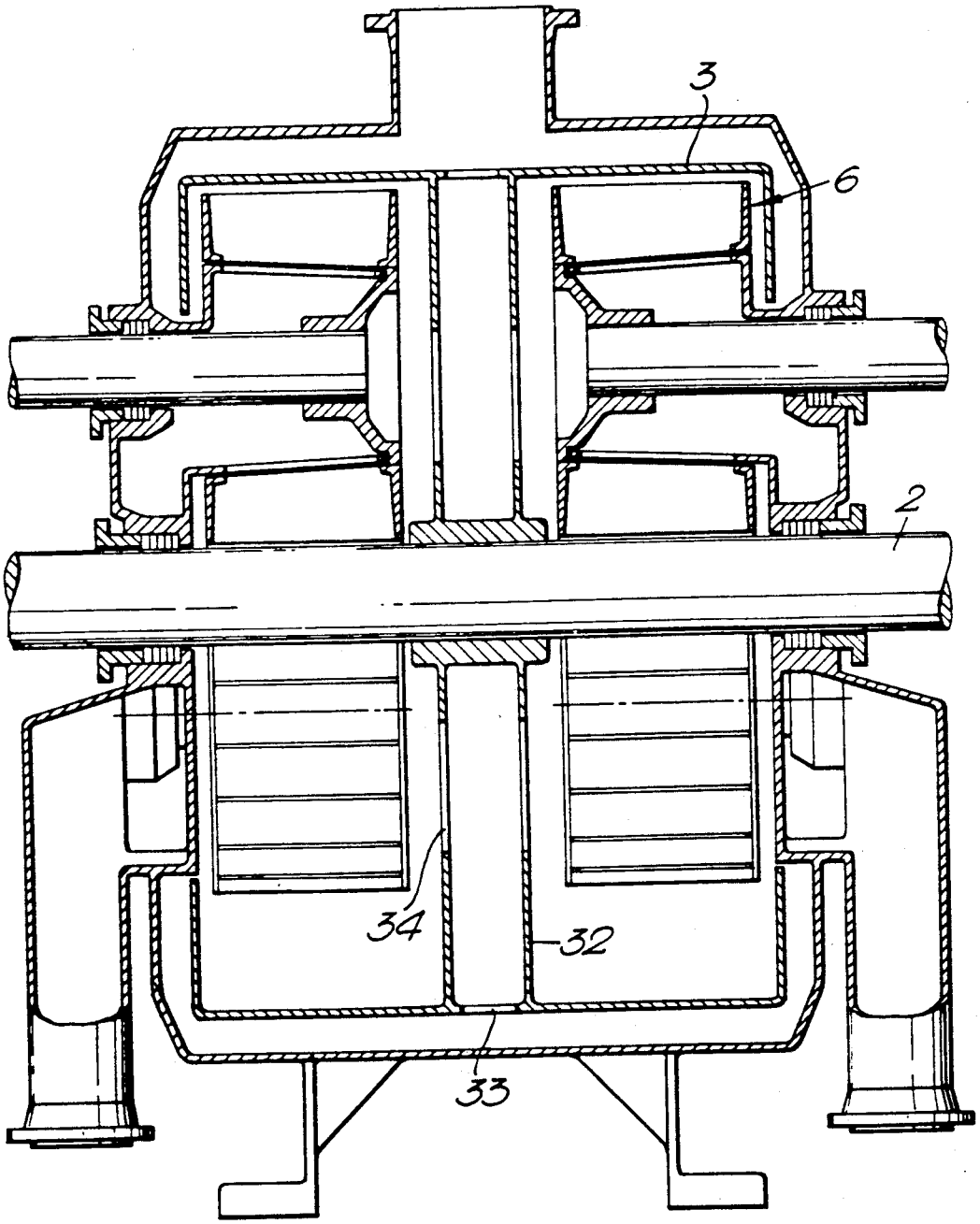
FIG. 7 shows a fifth compressor as per the invention as seen from the front.

The guide plate 29' can also be used in construction as shown in FIG. 5. In the arrangement shown in FIG. 7, the axle 2 of the rotary drum is attached to the casing 1 with bearings at both ends. The drum 3 is fixed in the centre of the axle 2 with two flanges 32. The space between the flanges 32 is connected to the casing 1 via 33 and inside the drums 3 via 34. In both drums 3 thus created there are three rotors 6, placed off-set from each other.

Figure 8:
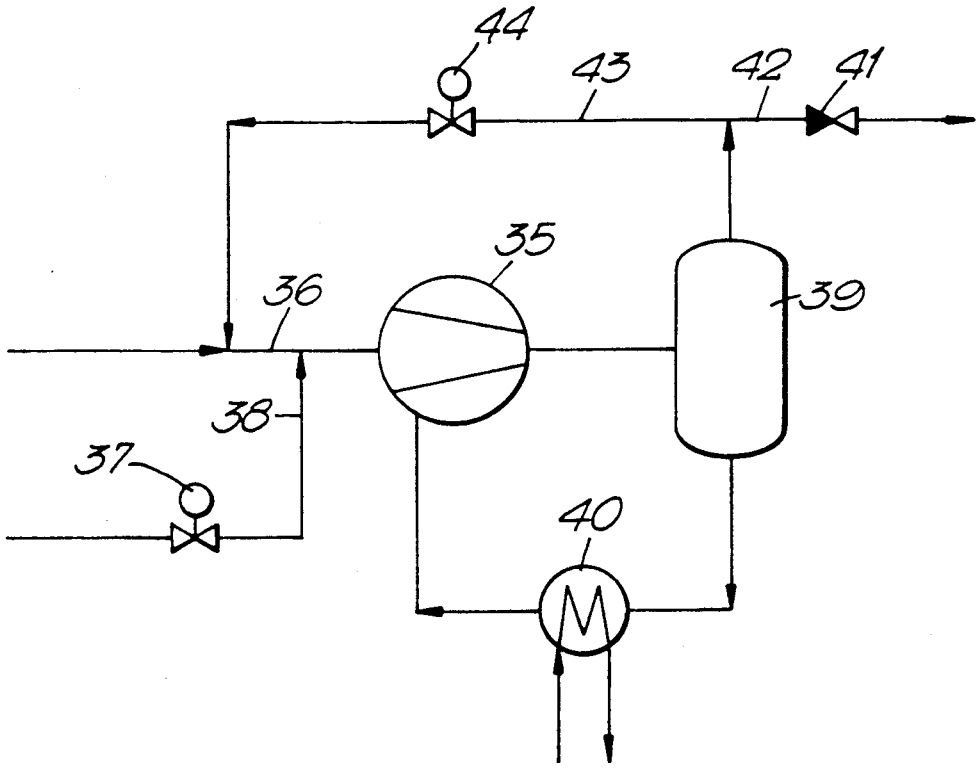
FIG. 8 shows the connections of compressors as per the invention.

FIG. 8 shows one arrangement for connecting the liquid ring compressor. The gas to be compressed is fed from the line 36 to the compressor 35. The replacement liquid is supplied from line 38 equipped with control valve 37. The compressed gas and the sealing liquid contained in are supplied to the separating tank 39. In it the sealing liquid is separated from the gas and returned to the compressor 35 via the cooler 40. The gas is supplied from the separating tank 39 to the discharge line 42 equipped with a non-return valve 41. The discharge line 42 is connected via the interconnection 43 to the supply line 36. The interconnection is provided with a throttle valve 44. The throttle valve 44 is open when the compressor is started. When the valve 44 is gradually throttled, the compressor reaches the desired discharge pressure.

I claim:

1. A liquid ring compressor consisting of:

a cylindrical casing having two ends with at least one of said ends provided with an opening in the center, an axle parallel to the longitudinal axis of said cylindrical casing, placed off-center through an opening in said cylindrical casing, wherein on said axle is a rotor designed to rotate in said cylindrical casing; said rotor having an end flange attached to the axle and; said end flange having rotor vanes parallel to the axle, wherein said rotor vanes are connected with a ring flange, an annular space between said rotor and said axle; said annular space being separated from said cylindrical casing by a cylindrical outer wall and end walls, said cylindrical casing being filled with a liquid which said rotating rotor forces to form a ring on the periphery of said cylindrical casing, a discharge opening in the wall of said annular space at the end of a compression zone; said compression zone being a zone in which the inner surface of the liquid ring approaches, in the direction of rotation of said cylindrical outer wall of said annular space, at least one intermediate outlet in said wall of said annular space, located ahead of said discharge opening, a discharge channel leading from said annular space through the opening at the end of said cylindrical casing, and a system for supplying gas into said cylindrical casing to rotor vane slots that are located in a suction zone; wherein said suction zone is the zone in which said inner surface of the liquid ring, in the direction of rotation, moves away from said cylindrical outer wall of said annular space, characterized in that said intermediate outlet is equipped with a valve preventing gas flow from the space between said rotor and said axle to said rotor vane slot in said compression zone.

2. A liquid ring compressor as in claim 1, in which said cylindrical casing is a rotating drum, and in which said rotor turns in the same direction as said rotating drum.

3. A liquid ring compressor as in claim 1, characterized in that wherein there is such an amount of liquid in said cylindrical casing that said rotor vanes in said induction zone become separated from said inner surface of said liquid ring.

4. A liquid ring compressor as in claim 1, characterized in that at least one of said intermediate outlets is a separate intermediate outlet leading to an intermediate discharge space separated from the annular space with a wall, from which said intermediate discharge space there is a separate intermediate outlet channel leading through said opening in said end of said cylindrical casing.

5. A liquid ring compressor as in claim 1, characterized in that it is equipped with a cooling system with which liquid can be injected into at least one vane slot in the compression or induction phase for the purpose of cooling down the gas to be compressed.

6. A liquid ring compressor as in claim 1, characterized in that there is an interconnection equipped with a valve from an outlet side to an inlet side of said liquid ring compressor.

7. A liquid ring compressor as in claim 2, characterized in that said rotor or said drum is equipped with ribs or wings to reduce the slip between said rotor and said drum or that wherein said rotor and said drum both rotate as positively guided in relation to each other.

8. A liquid ring compressor as in claim 2, characterized in that said cylindrical casing contains two drums attached on the same axle.

9. A liquid ring compressor as in claim 1, characterized in that there is a guide plate fitted outside said rotor periphery to improve the volumetric efficiency.

10. A liquid ring compressor as in claim 1, characterized in that said vane slots in the induction phase are connected via grooves with said inlet space.

11. A liquid ring compressor as in claim 3, characterized in that there are two or more rotors in said cylindrical casing.

12. A liquid ring compressor as in claim 1, characterized in that it is equipped with a cooling system with which liquid can be injected into at least one vane slot in the compression or induction phase for the purpose of cooling down said liquid ring.

* * * * *